US011013308B2

(12) United States Patent
Jones

(10) Patent No.: US 11,013,308 B2
(45) Date of Patent: May 25, 2021

(54) APPARATUS FOR CARRYING ELECTRONIC DEVICE

(71) Applicant: Lucille Jones, Boston, MA (US)

(72) Inventor: Lucille Jones, Boston, MA (US)

( * ) Notice: Subject to any disclaimer, the term of this patent is extended or adjusted under 35 U.S.C. 154(b) by 0 days.

(21) Appl. No.: 16/749,268

(22) Filed: Jan. 22, 2020

(65) Prior Publication Data

US 2020/0229577 A1 Jul. 23, 2020

Related U.S. Application Data

(60) Provisional application No. 62/795,256, filed on Jan. 22, 2019.

(51) Int. Cl.
*A45F 3/14* (2006.01)
*A45F 3/00* (2006.01)

(52) U.S. Cl.
CPC ..... *A45F 3/14* (2013.01); *A45F 2003/003* (2013.01); *A45F 2003/142* (2013.01); *A45F 2200/0516* (2013.01); *A45F 2200/0525* (2013.01)

(58) Field of Classification Search
CPC ..... A45F 3/14; A45F 2200/0525; A45F 2200/0516; A45F 2003/003; A45F 2003/142; Y10S 224/93
See application file for complete search history.

(56) References Cited

U.S. PATENT DOCUMENTS

2004/0011841 A1* 1/2004 Sprague ..... A45C 13/30 224/638
2004/0200870 A1* 10/2004 Haber ..... B44D 3/02 224/259
2009/0159630 A1* 6/2009 Ko ..... A45F 5/00 224/648
2014/0166658 A1* 6/2014 Hamra ..... A45F 5/02 220/500
2015/0083765 A1* 3/2015 Cox ..... A45F 3/14 224/259
2016/0033235 A1* 2/2016 Kinnings ..... F41H 1/02 2/102
2016/0106199 A1* 4/2016 Hairston ..... A45F 3/14 224/633
2016/0147254 A1* 5/2016 Daley, III ..... G06F 1/1616 348/725
2016/0154426 A1* 6/2016 Daley, III ..... G06F 1/1698 361/679.03

(Continued)

*Primary Examiner* — Brian D Nash
(74) *Attorney, Agent, or Firm* — Wilmer Cutler Pickering Hale and Dorr LLP

(57) ABSTRACT

Provided herein is a carrier system for securely holding an electronic device while enabling easy access to the electronic device when the electronic device is held by the system. In some embodiments, the carrier system includes a harness having at least two shoulder straps and one belt. In some embodiments, the length of the shoulder straps and belt is adjustable. Each of the shoulder straps is configured to be worn over a respective shoulder of a user, and each of which are coupled to the belt. In some embodiment, a carrier system having a backplate, coupled to the shoulder straps, and a front plate is connected to the harness to provide handsfree access to the electronic device. In some embodiments an adjustor is placed within the device carrier to allow the device carrier to securely hold a device smaller than the device carrier's holding compartment.

10 Claims, 9 Drawing Sheets

(56) References Cited

U.S. PATENT DOCUMENTS

| | | | | |
|---|---|---|---|---|
| 2017/0068270 | A1* | 3/2017 | Kielland | F16M 13/04 |
| 2018/0206619 | A1* | 7/2018 | Picking | A45F 3/04 |
| 2019/0159579 | A1* | 5/2019 | Picking | A45F 5/021 |

* cited by examiner

APPARATUS FOR CARRYING ELECTRONIC DEVICE

RELATED APPLICATION

This application claims the benefit of U.S. Provisional Application No. 62/795,256, filed Jan. 22, 2019, which is incorporated by reference herein in its entirety.

TECHNICAL FIELD

This application relates to a device carrier system that provides a full enclosure to protect the electronic device within, and enables the user to access and operate the electronic device without needing his or her hand or hands to hold the device.

BACKGROUND

Strap-on carriers for carrying mobile phones have been known. See for example, US Application No. 2015/0076183. However, conventional strap-on carriers do not allow users to operate the device handsfree. They lack the supporting structure necessary to hold the phone in a steady position to allow the user to use the phone with both hands without needing the user to also hold the device. Other strap-on carriers with mechanical clamps and hinges have also been explored. These types of carriers generally lack edge to edge protection for the attached device. For example, when the device is attached, it is still exposed to external elements such as rain. In addition, it is not easy to attach and detach the device with these types of carrier. Multiple mechanical parts need to be aligned and secured or removed.

According to certain embodiments, the device carrier system disclosed herein is designed to allow handsfree operation of a hand-held device and protect the enclosed device from external elements.

SUMMARY

Preferred embodiments of the invention provide a device carrier system for securely holding an electronic device while enabling easy access to the electronic device when the electronic device is held by the system. When the carrier device is closed, the device carrier system would prevent the enclosed electronic device from elemental damages such as water or dirt. When the carrier device is open, the user may access the electronic device without needing to hold the device in his or her hand.

Disclosed embodiments include, in one aspect, a device carrier system having a device carrier connected to a harness. The device carrier is suitable for holding various electronic devices including but not limited to smart phones, PDAs, and/or hand-held game consoles. In some embodiments, the device carrier has a backplate rotatably connected to an outer casing via a rotatable joint. The rotatable joint allows the outer casing to rotate away from the backplate. In some embodiments, the outer casing is a front plate. In some embodiments, the outer casing has a holding compartment, or a cavity, formed by one or more enclosure sides. In the closed position, the enclosure sides, together with the outer casing, prevent external elements such as rain or dirt from damaging the device. In certain aspects, the device carrier can be connected to a harness in a variety of ways. For example, the device carrier may be attached to a harness via snap tabs, buckles, or Velcro. Regardless of the connecting mechanism, it is preferred for the device carrier to be easily detachable from the harness. This feature allows the user to quickly remove the device from the harness and use the device for other purposes such as for scanning a barcode displayed on the device.

In certain aspects, the harness is composed of two shoulder straps and a waist band. In some embodiments, the device carrier can be attached to the two shoulder straps of the harness, close to the user's chest area via snap tabs. This configuration allows the user to operate the enclosed electronic device and without needing to hold the device in his or her hands. In some embodiments, the position of the carrier device is adjustable on the harness depending on the location of the connecting mechanism. Also, it is understood that harnesses of various configurations are suitable for this invention.

Before explaining exemplary embodiments in detail, it is to be understood that the disclosure is not limited in its application to the details of construction and to the arrangements set forth in the following description or illustrated in the drawings. The disclosure is capable of embodiments in addition to those described and is capable of being practiced and carried out in various ways. Also, it is to be understood that the phraseology and terminology employed herein, as well as in the abstract, are for the purpose of description and should not be regarded as limiting.

These and other capabilities of disclosed embodiments will be more fully understood after a review of the following figures, detailed description, and claims.

It is to be understood that both the foregoing general description and the following detailed description are explanatory only and are not restrictive of the claimed subject matter.

BRIEF DESCRIPTION OF DRAWINGS

Various objects, features, and advantages of the disclosed subject matter can be more fully appreciated with reference to the following detailed description of the disclosed subject matter when considered in connection with the following drawings, in which like reference numerals identify like elements. While multiple embodiments are disclosed, still other embodiments of the present disclosure will become apparent to those skilled in the art from the following detailed description, which shows and describes illustrative embodiments of the disclosure. Accordingly, the drawings and detailed description are to be regarded as illustrative in nature and not restrictive.

DETAILED DESCRIPTION

In the following description, numerous specific details are set forth regarding the systems and methods of the disclosed subject matter and the environment in which such systems and methods may operate, in order to provide a thorough understanding of the disclosed subject matter. It will be apparent to one skilled in the art, however, that the disclosed subject matter may be practiced without such specific details, and that certain features, which are well known in the art, are not described in detail in order to avoid complication of the disclosed subject matter. In addition, it will be understood that the examples provided below are exemplary, and that it is contemplated that there are other systems and methods that are within the scope of the disclosed subject matter.

Figure 1:
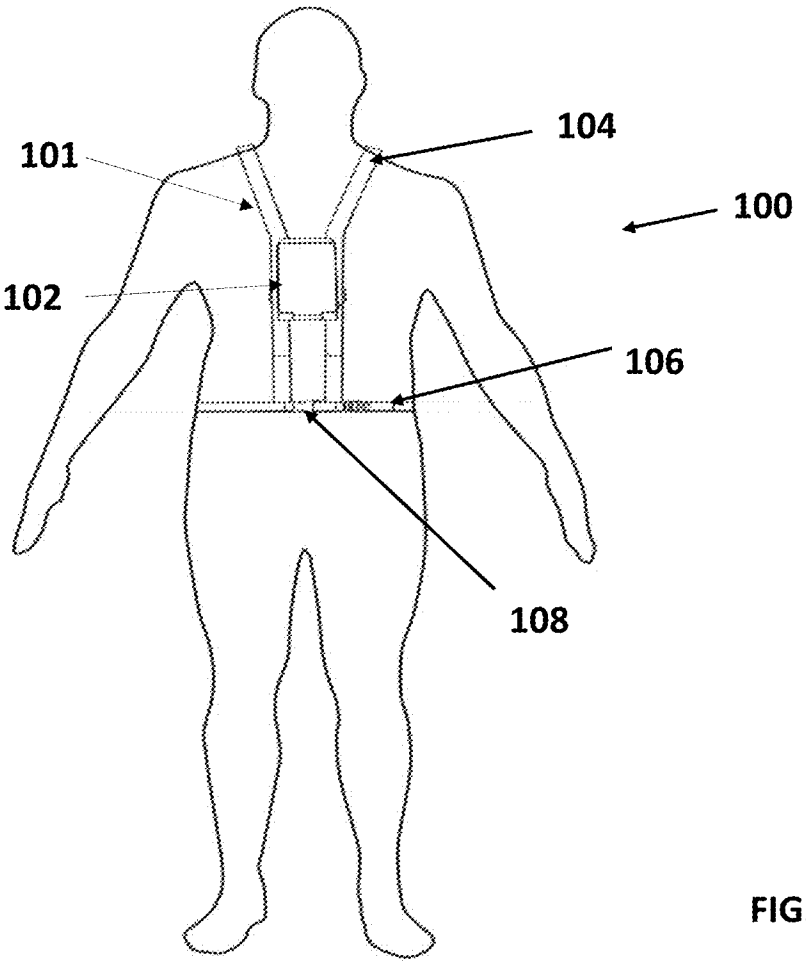
FIG. 1 illustrates a device carrier being worn on a user according to certain embodiments.

FIG. 1 illustrates a device carrier system 100 for securely holding an electronic device while enabling easy access to the electronic device when the electronic device is held by the device carrier system, according to certain embodiments. In FIG. 1, the device carrier 102 is attached to the harness 101 close to the chest/abdominal location. Harness 101 is composed of shoulder straps 104 connected to the belt 106. The belt 106 is secured around the user's waist via the buckle 108. In FIG. 1, the device carrier 102 is in a closed position. According to some embodiments, the location of the device carrier 102 can be adjusted up or down the shoulder straps 104. For example, in some embodiments, the device carrier 102 is attached closer to the waist section. According to certain embodiments, the shoulder straps 104 can be adjusted closer together or wider apart along the belt 106. In some embodiments, the buckle 108 can be replaced with other fasteners such as Velcro or snap tabs. In some embodiments, the lengths of the shoulder straps 104 and belt 106 are adjustable.

According to certain embodiments, the device carrier system 100 allows the user to access and operate a device handsfree. For example, a chef could place his or her phone in the device carrier 102 when walking to work. At work, the chef can open the device carrier 102 to read notes on the phone while cooking with two hands.

Figure 2A:
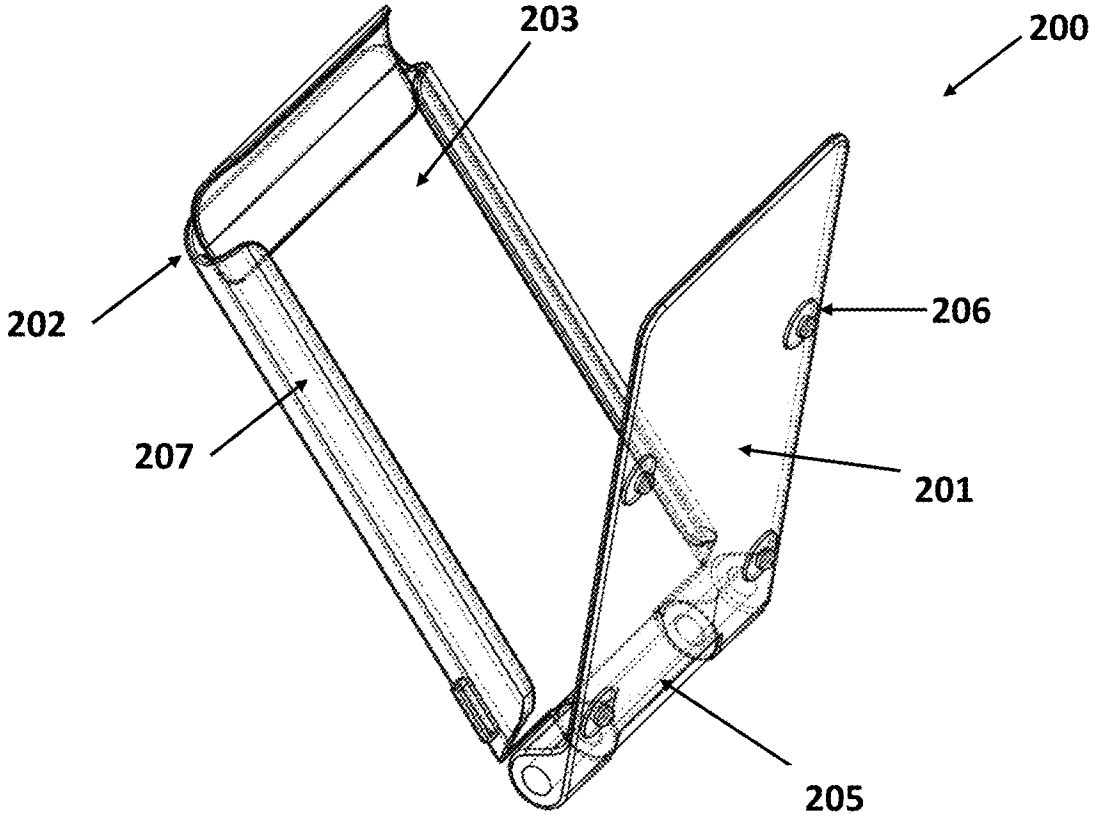
FIG. 2A illustrates a side view of a device carrier in a half-opened position according to certain embodiments.

FIG. 2A illustrates a device carrier 200 in a half-opened position according to certain embodiments. The device carrier 200 has a backplate 201 with four snap tabs 206, and an outer casing 202 with an internal holding compartment 203 surrounded by one or more enclosure members 207. In some embodiments, the outer casing 202 may comprise just a front plate (i.e. without enclosure members 207). The bottom hinge 205 of the device carrier 200 connects the backplate 201 with the outer casing 202. In some embodiments, bottom hinge 205 is rotatable. According to some embodiments, the device carrier is sized to hold an electronic device while exposing the user interface of the device (e.g., the touch screen or keypad of the device). In some embodiments, the bottom joint 205 is a mechanical elbow that allows the carrier device to open from 0 to 180 degrees. In some embodiments, the bottom joint 205 is a plastic joint, rubber joint, metal joint, or a combination thereof. In some embodiments, the bottom joint 205 is detachable such that the outer casing 202 can be separated from the backplate 201.

Figure 2B:
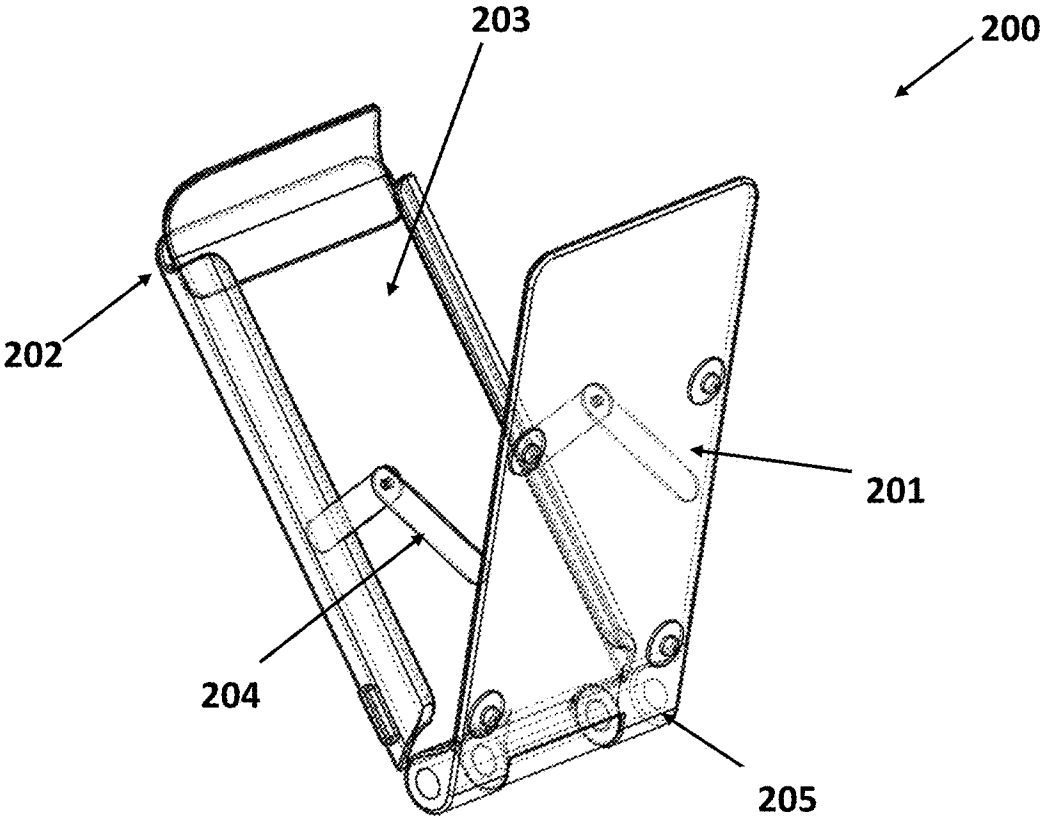
FIG. 2B illustrates a side view of a device carrier with linking hinges in a half-opened position according to certain embodiments.

In some embodiments, as shown in FIG. 2B, one or more linking hinges 204 are used to connect the outer casing 202 and the backplate 201 in a position close to the bottom joint 205. In some embodiments, the linking hinge 204 allows the device carrier to open and hold in discrete angles. For example, linking hinge 204 of a device carrier 200 may only open to about 45 and 90 degrees (when the linking hinge is completely straightened). In some embodiments, the linking hinge 204 can open and hold any angles from 0 to about 180 degrees (e.g., when the linking hinge is complete straightened). According to some embodiments, when the linking hinge 204 is straight, the device carrier is fully open. In some embodiments, the linking hinge 204 can be disconnected. Such a configuration would allow the outer casing 202 to be detached from the backplate 201.

The linking hinge 204 can be made of metal, alloy, plastic, fortified plastic, or a combination thereof. In some embodiments, the linking hinge operates like a piano hinge such that when it is opened at about 45 degrees the user can see the screen. And when the linking hinge is opened at about 90 degrees the user can have full access to the touch screen display. In some embodiments, the linking hinge 204 has an embedded bias spring that pushes the outer casing away from the backplate. In some embodiments, the linking hinge does not have a bias spring and requires the user to manually open and close the device carrier.

In some embodiments the outer casing 202 has one or more carved-out space (not shown) in the holding compartment to allow certain features on the device to be exposed, for example, a window for a mobile phone's camera lenses. In some embodiments, the bottom joint 205 has one or more carved-out spaces to allow access to the headphone and charging plugs. In some embodiments, the access for the headphone and charging plugs are on the outer casing. In some embodiments, the outer casing has a carved-out space for a power button. In some embodiments, the carved-out space is covered with a transparent material such as a glass, clear vinyl, plastic, or a combination thereof.

In some embodiments, a protective layer is installed over the holding compartment for protecting the carried device from external elements. For example, a user may be drinking coffee while walking with the device carrier in an open position. An accidental spillage might damage the device within. If a protective layer is installed, the spillage would not come in contact with the device, and thus protects the device from water damage.

Referring to FIG. 2A, a protective layer may be installed under or over the enclosure members 207. In some embodiments, the protective layer fully covers the device within the holding compartment 203. In some embodiments, the coverage is partial. According to some embodiments, the protective layer is made of a transparent material such as plastic, silicon, glass, clear vinyl, or a combination thereof. In some embodiments, the protective layer enables the user to operate the device directly without needing to remove the protective layer. For instance, the user may swipe and tab smartphone icons via the protective layer. In some embodiments, the protective layer is not water permeable. In some embodiments, the protective layer has anti-glare technology. In some embodiments, the protective layer is a polarized glass or plastic so that the enclosed device can only be viewed from certain angles.

Figure 3:
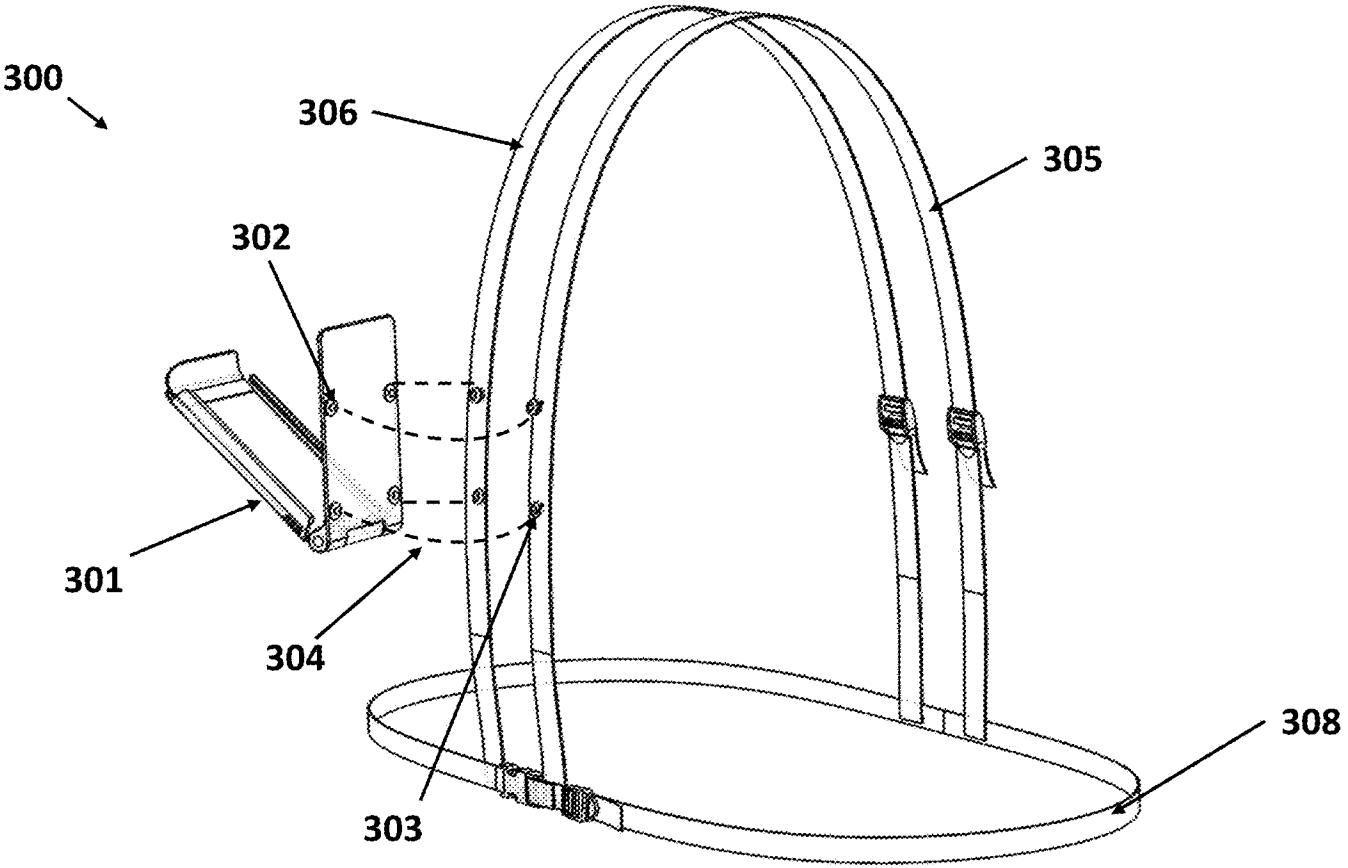
FIG. 3 illustrates an attaching mechanism for a device carrier according to certain embodiments.

FIG. 3 illustrates an attaching mechanism 300 for the device carrier 301 according to certain embodiments. The device carrier 301 has snap tabs 302 configured to connect with the snap tabs 303 on the chest straps 306 of the harness 305. In some embodiments, the harness 305 has a waist strap 308 configured to wrap around the user's waist to provide additional support. According to certain embodiments, the device carrier 301 is connected to the harness 305 by pressing the snap tabs 302 against the corresponding snap tabs 303 on the harness. In certain embodiments, less than or more than four snap tabs are used. In some embodiments, Velcro is used instead of the snap tabs. Other attachment mechanisms are also within the scope of the invention, for instance, magnets, buckle tabs, click-in mechanisms, or a combination thereof, may also be used. According to certain embodiments, the attachment mechanism is configured for easy and fast removal of the device carrier.

Figure 4:
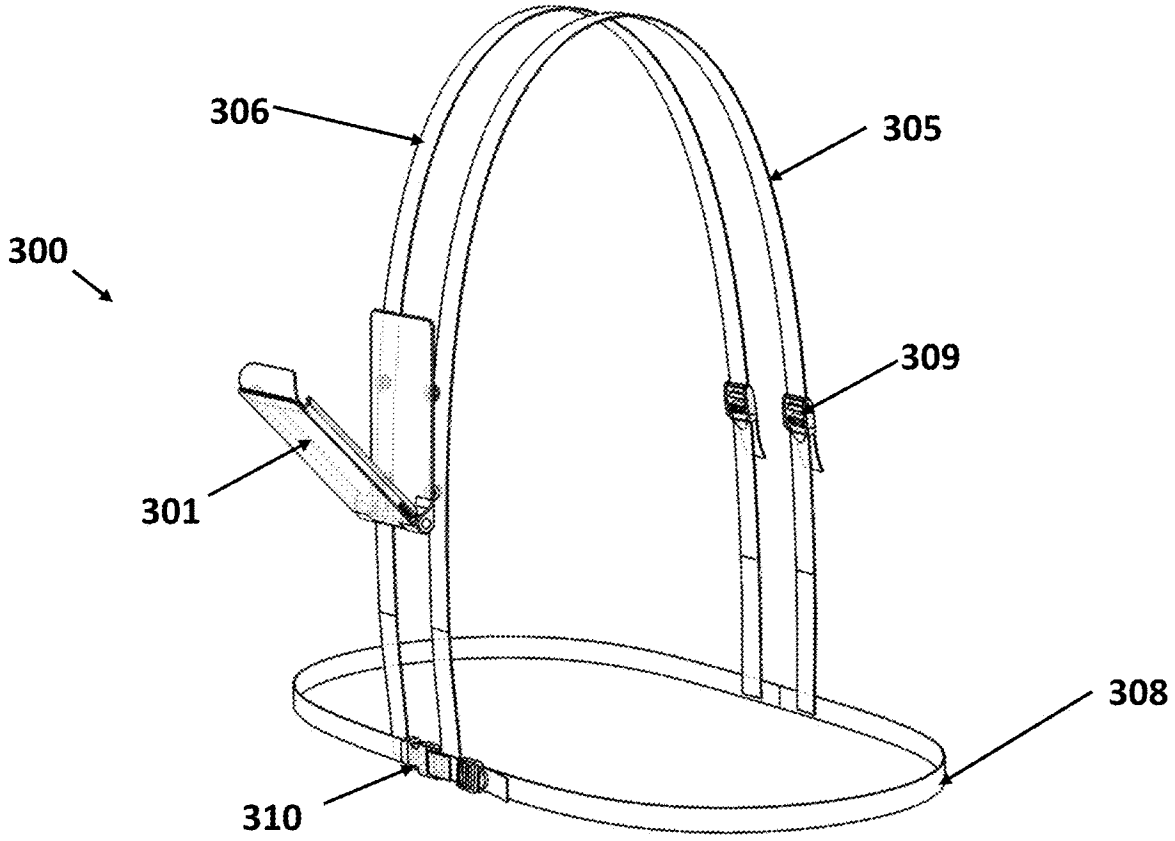
FIG. 4 illustrates an opened device carrier attached to a harness according to certain embodiments.

FIG. 4 illustrates how the device carrier 301 is attached to the harness 305 while in its half-opened position. The strap adjustors 309 allows the user to adjust the length of the strap. In some embodiments, the position of the strap adjustors 309 can be changed. For example, the strap adjustors may be positioned closer to the user's chase or stomach area. Similarly, in some embodiments the location of the buckle 310 can also be adjusted along the belt 308. In some embodiments, the adjustment mechanism for the harness can be belt buckles, belt snaps, magnets, or a combination thereof. According to certain embodiments, the harness is made of lightweight fabric, nylon, or other suitable materials. In some embodiments, the snap tabs are made of plastic, recycled plastic, metal, alloy, or a combination thereof.

According to certain embodiments, the attachment mechanism is configured to enable easy and fast attachment and removal of the device carrier. In some embodiments, once the device carrier is attached it will stay attached during walking or running. In some embodiments, the device carrier is suitable for smart phones, tablets, or other consumer electronics that could fit within the device carrier. In some embodiments, the harness can be adjusted while the device carrier is attached.

Figure 5:
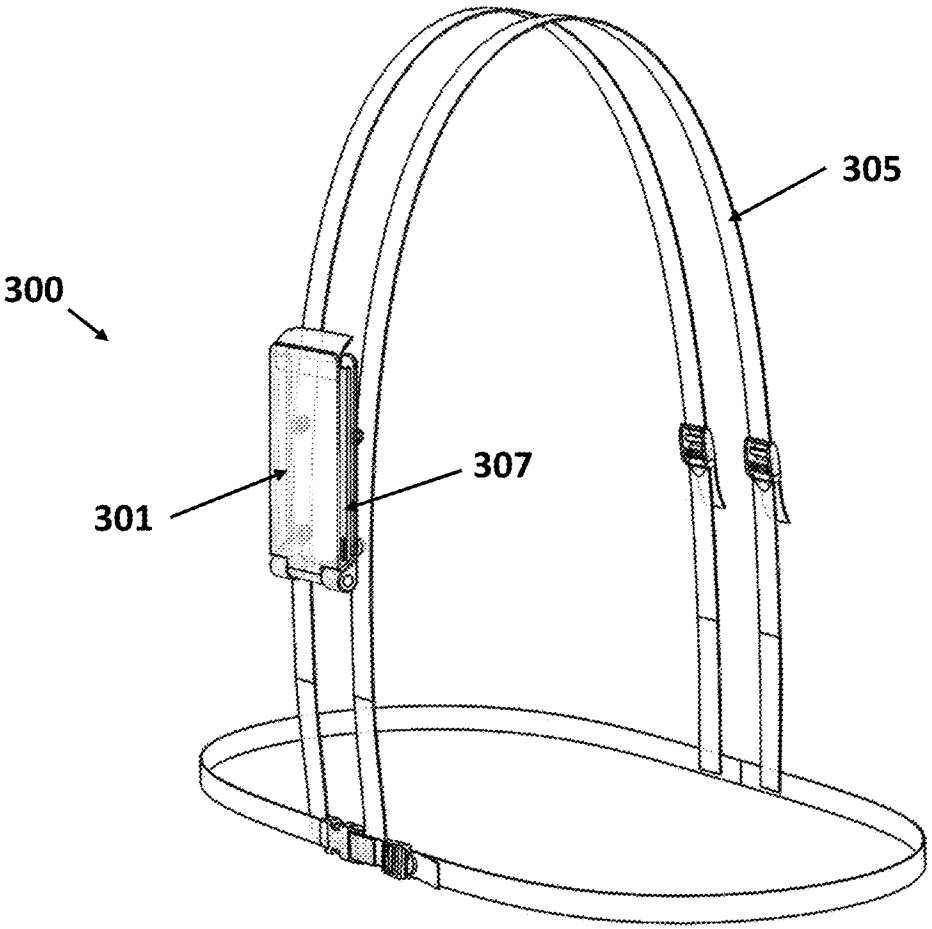
FIG. 5 illustrates a closed device carrier attached to a harness according to certain embodiments.

FIG. 5 illustrates how the device carrier 301 is attached to the harness 305 while in its closed position. In FIG. 5, the enclosure member 307 is sandwiched between the outer casing (or the front plate) and the backplate. According to some embodiments (see, e.g., FIG. 6), the enclosure member 307 may wrap around the backplate when the device carrier is closed. In some embodiments, the device carrier 301 has a rigid form and is made of rigid material such as metal, plastic, glass, wood, or a combination thereof. In some embodiments, the device carrier 301 is made of bendable or foldable materials such as fabric or rubber. In these embodiments, the body of the device carrier can be collapsed. One advantage of using bendable materials is to allow the device carrier to be collapsed into a smaller size for ease of transportation. In some embodiments, the backplate and/or the outer casing of the device carrier is made of transparent or opaque materials such that the device being held can be seen from the outside of the carrier device.

Figure 6:
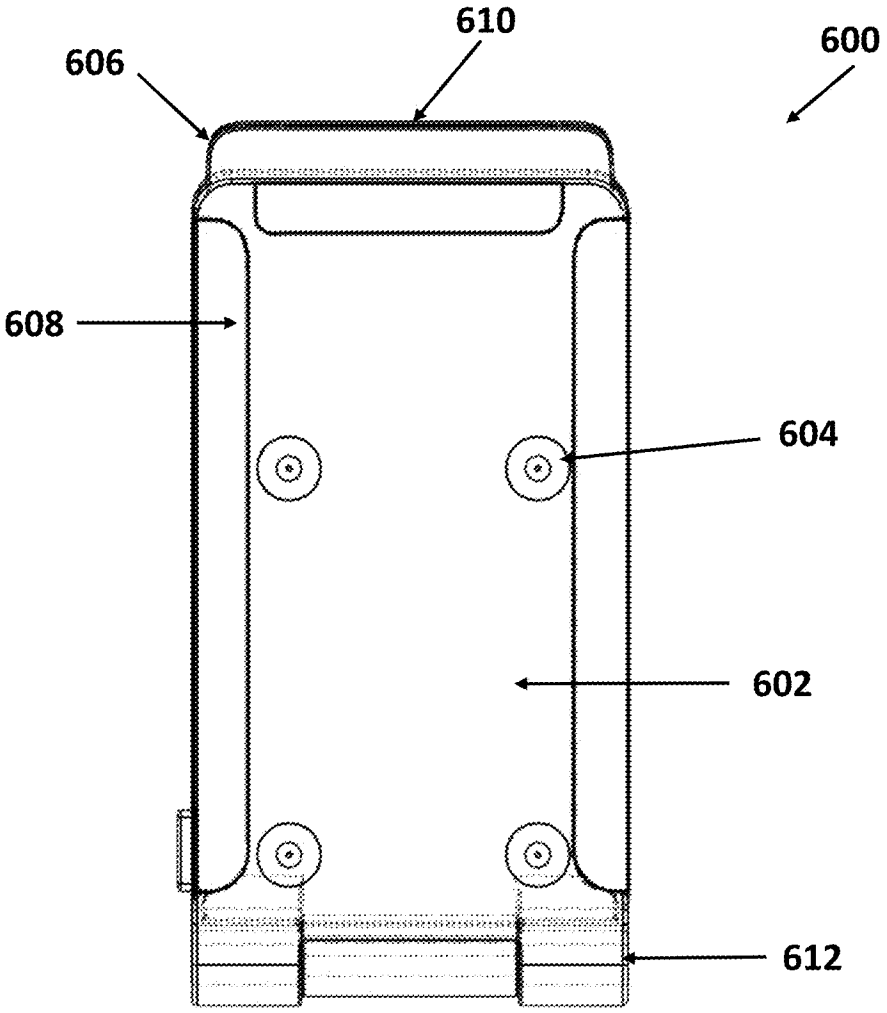
FIG. 6 illustrates a backside view of a device carrier in a closed position according to certain embodiments.

FIG. 6 shows the backside view of a device carrier 600 in a closed position according to certain embodiments. The backside refers to the side that has attachment mechanisms for securing the device carrier to another object such as a harness. In FIG. 6, device carrier 600 includes backplate 602 with four snap tabs 604. The outer casing 606 has enclosure members 608 that partially cover parts of the backplate 602. According to certain embodiments, the enclosure member 608 enables the outer casing 606 to hug the backplate 602 in the closed position. The top cover 610 provides an additional enclosure to protect the enclosed device. In some embodiments, the top cover 610 includes a magnet or hook-and-loop type of fastener (e.g., Velcro) to attach the top cover 610 over the backplate 602. According to certain embodiments, the top cover 610 has sufficient padding to protect the top edge of the enclosed device. The bottom edge 602 has a curved design to secure the phone within. In some embodiments, the bottom edge 602 has a mechanical joint that allows the carrier 600 to open and close. In some embodiments, the device carrier 600 is about 8 inches long, 3.5 inches wide, and 1 inch thick in the closed position.

In some embodiments, the device carrier 600 is made of plastic, recycled plastic, fiberglass, fortified plastic, wood, metal, alloy, or a combination thereof. In some embodiments, the materials are covered with waterproof vinyl. In some embodiments, other attachment mechanisms such as magnet can be used instead of the snap tabs 604. According to certain embodiments, the outer casing (or front plate) 606 is made of leather, plastic, fortified plastic, fiberglass, or a combination thereof. In some embodiments, the backplate 602 is made of a different material than the outer casing (or front plate) 606. In some embodiments, the backplate 602 is made of a rigid material such as plastic, recycled plastic, fiberglass, fortified plastic, wood, metal, alloy, or a combination thereof. In some embodiments, the backplate and outer casings (or front plate) are transparent or opaque.

In some embodiments, the enclosure members 608 are flexible membranes that can hold the enclosed position even when the carrier is open. For example, according to certain embodiments the flexible membrane is rigid enough to retain the device within even when the device carrier is open. In some embodiments, the flexible membranes are made of rubber, silicon, leather, or a combination thereof. In some embodiments, the enclosure members 608 are rigid flaps. In some embodiments the rigid flaps are connected to one or more mechanical joints to allow the flaps to open and close. In some embodiments, the flaps are made of plastic, fortified fiber, recycled plastic, or a combination thereof.

Figure 7:
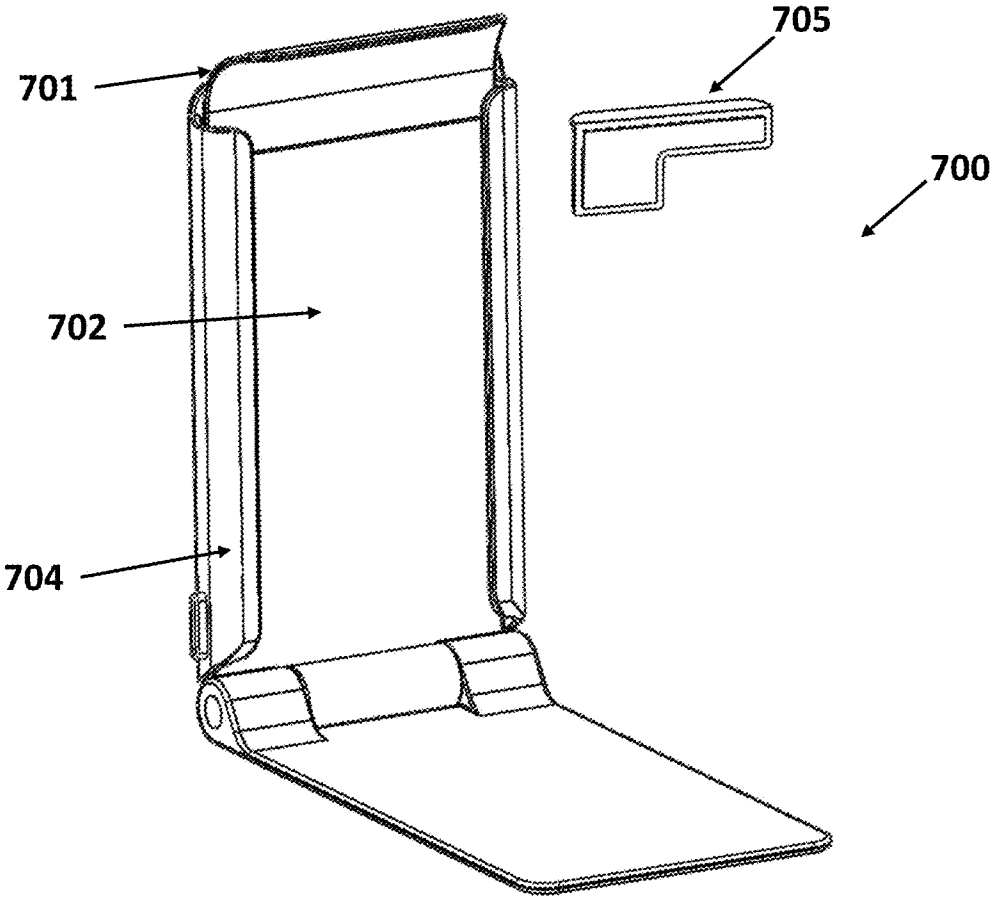
FIG. 7 illustrates the inside of the holding compartment of a device carrier without an adjustor according to certain embodiments.

FIG. 7 illustrates the holding compartment of a device carrier 700 while the device carrier is in an open position according to certain embodiments. The outer casing (or front plate) 701 has an enclosed cavity/pocket surrounded by one or more enclosure members 704 to create a holding compartment 702. In some embodiments, the holding compartment 702 is configured to hold a device that is about 8 inches tall and 4 inches wide. It is contemplated that holding compartments of different sizes are within the scope of the present disclosure.

Figure 8:
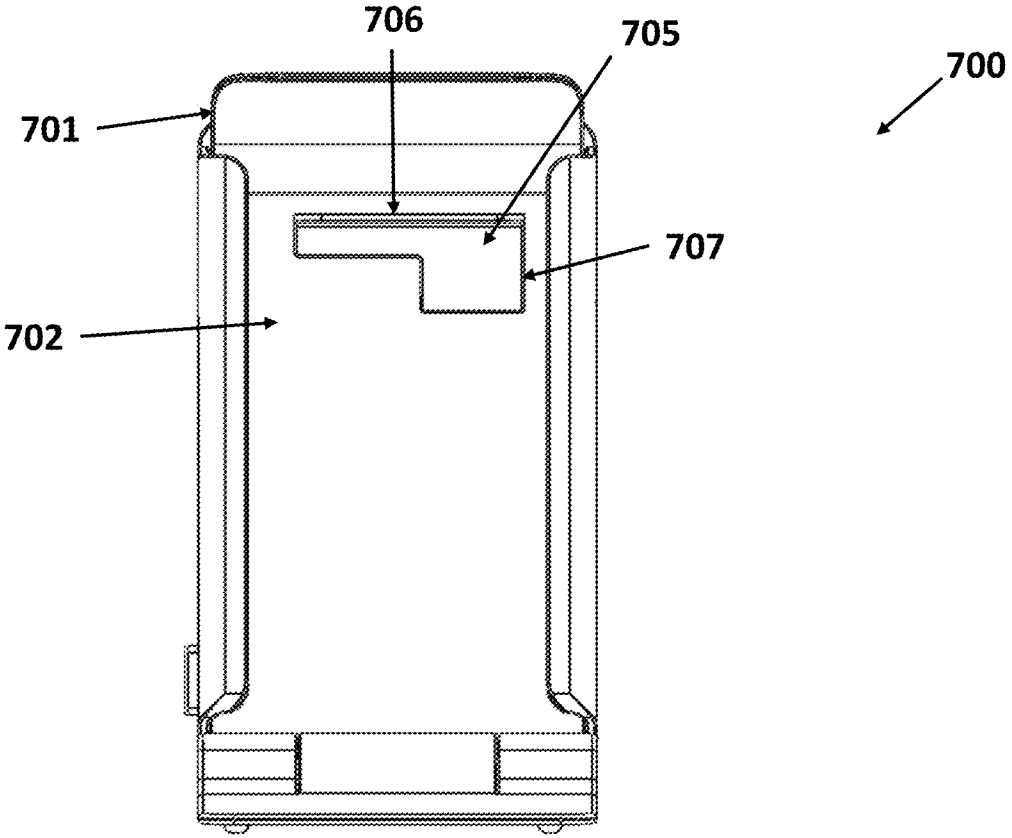
FIG. 8 illustrates the inside of the holding compartment of a device carrier with an adjustor according to certain embodiments.

FIG. 8 illustrates the holding compartment 702 installed with an adjustor 705 according to certain embodiments. The adjustor 705 is installed in the holding compartment 702 of the outer casing (or front plate) 701 to apply firm holding on the electronic device smaller than the holding compartment 702. In some embodiments, the adjuster 705 is a strap with Velcro. In some instances, the Velcro can be attached to another Velcro on the back of a device. In some embodiments, the outer side of the adjustor 705 (e.g., a strap) is smooth, and the inner side is a hook-and-loop type of fastener (e.g., Velcro). In some embodiments, the inner side has a friction texture to facilitate handling. In some embodiments, the hook-and-loop type of fastener is only placed at the ends of the adjustor (e.g., at the tips of a strap). In some embodiments, the strap type adjustor is elastic or has other length adjustable features to make it either longer or shorter. In some embodiments, the adjustor 705 is a clamp or slider clamp. The clamp can have one or more bias springs to enable the clamp to hold a smaller device in a fixed position. In some embodiments, the adjustor 705 has other securing mechanisms such as a buckle or tab. In some embodiments, magnet can be used in place of, or in combination with, the adjustor 705 to stabilize and hold a device in place.

It is contemplated that apparatus and processes of the disclosed invention encompass variations and adaptations developed using information from the embodiments described herein. Adaptation and/or modification of the system, devices, and apparatus described herein may be performed by those of ordinary skill in the relevant art.

Throughout the description, where articles, devices, and systems are described as having, including, or comprising specific components, it is contemplated that, additionally, there are articles, devices, and systems of the present disclosure that consist essentially of, or consist of, the recited components.

It should be understood that the order of steps or order for performing certain actions is immaterial so long as the disclosure remains operable. Moreover, two or more steps or actions may be conducted simultaneously. The mention herein of any publication, for example, in the Background section, is not an admission that the publication serves as prior art. The Background section is presented for purposes of clarity and is not meant as a description of prior art.

It is to be understood that the disclosed subject matter is not limited in its application to the details of construction and to the arrangements of the components set forth in the description or illustrated in the drawings. The disclosed subject matter is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the design of other structures, methods, and systems for carrying out the several purposes of the disclosed subject matter.

Although the disclosed subject matter has been described and illustrated in the foregoing exemplary embodiments, it is understood that the present disclosure has been made only by way of example, and that numerous changes in the details of implementation of the disclosed subject matter may be made without departing from the spirit and scope of the disclosed subject matter.

What is claimed is:

1. A system for securely holding an electronic device while enabling easy access to the electronic device when the electronic device is held by the system, comprising:

a harness having at least two shoulder straps and one belt wherein each of the shoulder straps is configured to be worn over a respective shoulder of a user, and each of which couples to the belt, and wherein the belt is configured to be worn around a waist of the user; and a device carrier having a backplate, coupled to the shoulder straps, a front plate, and one or more enclosure members, wherein the backplate and the front plate are coupled via a hinge at a distal end of the front plate so that the front plate may be rotated away from the backplate, wherein one or more enclosure members, in combination with the interior of the front plate creates a holding compartment, wherein the front plate and backplate are configured relative to one another that a closed position securely holds the front plate to the backplate, and an open position holds the front plate stably in spaced, rotated relationship to the backplate, wherein the front plate includes holding mechanism to securely hold the electronic device so that a display of the electronic device faces the backplate in the closed position and faces generally upward when the harness is worn by the user, wherein an adjustor configured to secure the electronic device when the electronic device is smaller than the holding compartment is installed within the holding compartment.

2. The system of claim 1, wherein the device carrier is coupled to the shoulder straps via one or more connectors located on the outer side of the backplate.

3. The system of claim 2, wherein the one or more connectors is a snap tab, magnet, buckle tab, click-in mechanism, or a hook-and-loop type fastener.

4. The system of claim 1, wherein the harness and the device carrier are connected via four snap tabs.

5. The system of claim 1, wherein the front plate can be detached from the backplate via the hinge at the distal end of the front plate.

6. The system of claim 5, wherein the linking hinge only allows the device carrier to open at about 45 or 90 degree angle.

7. The system of claim 5, wherein the linking hinge includes a bias spring that pushes the front plate away from the backplate.

8. The system of claim 1, wherein the backplate and front plate are further connected via at least one linking hinge.

9. The system of claim 1, wherein the device carrier is configured to open and hold at a discrete angle.

10. The system of claim 1, wherein the length of the shoulder straps is adjustable.

* * * * *